US008167271B2

(12) United States Patent
Boudreau

(10) Patent No.: US 8,167,271 B2
(45) Date of Patent: May 1, 2012

(54) STAPLE EXTRACTOR

(76) Inventor: Wendy Janet Boudreau, Prince Rupert (CA)

( * ) Notice: Subject to any disclaimer, the term of this patent is extended or adjusted under 35 U.S.C. 154(b) by 1004 days.

(21) Appl. No.: 11/465,738

(22) Filed: Aug. 18, 2006

(65) Prior Publication Data

US 2008/0042113 A1 Feb. 21, 2008

(51) Int. Cl.
*B25C 11/00* (2006.01)

(52) U.S. Cl. ..... 254/28

(58) Field of Classification Search ..... 254/28, 254/131, 25, 23; 269/257, 156; 294/100, 294/103.1; 606/138–139, 142, 170–172, 606/187

See application file for complete search history.

(56) References Cited

U.S. PATENT DOCUMENTS

| | | | | |
|---|---|---|---|---|
| 602,911 | A * | 4/1898 | Mitchell | 254/28 |
| 1,258,016 | A * | 3/1918 | Kepner | 294/103.1 |
| 1,526,517 | A * | 2/1925 | Voght | 294/10 |
| 3,583,673 | A | 6/1971 | Poskin | |
| 4,553,737 | A | 11/1985 | Yi | |
| 5,031,881 | A | 7/1991 | Thurmston | |
| 5,090,663 | A | 2/1992 | Crutchfield et al. | |
| 6,308,935 | B1 | 10/2001 | Rocheford | |
| 6,807,699 | B2 | 10/2004 | Michelman | |

* cited by examiner

*Primary Examiner* — Joseph J Hail
*Assistant Examiner* — Jamal Daniel

(57) ABSTRACT

A staple extractor having a handle, a shank attached to the handle and having a conical pry tip, and a sliding member having a clamp head engageable with the pry tip and slidably attached to the shank so as to permit relative longitudinal movement between the shank and sliding member, wherein the clamp head has opposed wings that straddle the pry tip so as to releasably secure a staple bridge. The sliding member has a thumb knob located proximate the handle for moving the sliding member between a retracted position and a clamping position.

13 Claims, 2 Drawing Sheets

STAPLE EXTRACTOR

FIELD OF THE INVENTION

This invention relates to a staple extractor for removing staples embedded in wood or other materials, such as staples used to attach upholstery to wood members in furniture.

BACKGROUND OF THE INVENTION

Numerous staple extractors have been developed and there are numerous patents covering staple extractors.

Several patents disclose specially configured tips for insertion under a staple bridge in order to remove the staple with a levering action of the tool. (In this application, including the claims, the term "bridge" is used to refer to the portion of a staple joining the two legs of the staple.) For example, U.S. Pat. No. 5,031,881, issued 16 Jul. 1991 to Thurmston; U.S. Pat. No. 3,583,673, issued 8 Jun. 1971 to Poskin; U.S. Pat. No. 4,553,737, issued 19 Nov. 1985 to Yi; U.S. Pat. No. 5,090,663, issued 25 Feb. 1992 to Crutchfield et al.; U.S. Pat. No. 6,308,935, issued 20 Oct. 2001 to Rocheford; and U.S. Pat. No. 6,807,699, issued 26 Oct. 2004 to Michelman.

Other patents disclose staple extractors in which, during use, the bridge of the staple is clamped between two pivotally attached members. For example:

1. U.S. Pat. No. 2,750,148, issued 12 Jun. 1956 to Burbank, discloses a device having a pivotally attached hook and prying end, wherein the hook is intended to latch onto a staple bridge to assist in the insertion of the prying end under the bridge and to retain the bridge on the prying end during extraction.
2. U.S. Pat. No. 4,293,119, issued 6 Oct. 1981 to Diederichs, discloses a device having a lower "jaw" for insertion under the bridge of a staple; an upper "jaw" pivotally connected to the lower jaw and spring biased into an open position opposite the lower jaw; and a handle pivotally connected to the lower jaw and linked to the upper jaw, such that in use a downward prying motion of the handle is intended to cause the lower and upper jaw to close, thus clamping the bridge of the staple during extraction.
3. U.S. Pat. No. 4,575,049, issued 11 Mar. 1986 to Fister, discloses a device having a concave tongue for insertion under the bridge of a staple, an opposed convex clamp and a housing, all pivotally linked, wherein in use, squeezing the handle of the device causes the clamp and tongue to close and lift together relative to the housing (braced against the surface containing the staple) so as to extract the staple.
4. U.S. Pat. No. 5,088,692, issued 18 Feb. 1992 to Weiler discloses a device having a pronged member with a double pronged prying end, and a shank pivotally attached to the pronged member and having an end interposable between the prongs, wherein in use the prongs are inserted under a staple bridge and the shank is pivoted relative to the pronged member so as to interpose the shank end between the prongs, thus deforming the bridge so as to clench it between the shank end and the prongs, thus securing the staple for extraction.

The devices disclosed in these patents suffer from a variety of deficiencies, particularly when considered in light of what is desirable in the removal of staples used in furniture, (such as to secure upholstery to wood members), which include that the staple extractor be useable with staples in confined or awkward locations, that the staple extractor permit the user to remove staples by either a levering action of the staple extractor or a direct pull, as the situation warrants; and that the staple extractor minimally mar adjacent surfaces during the extraction process.

SUMMARY OF THE INVENTION

In accordance with the present invention, there is provided a staple extractor for removing staples embedded in wood or other materials, such as staples used to attach upholstery to wood members in furniture.

In one aspect, the staple extractor of the present invention includes a shank having a pry tip, and a sliding member having a clamp head engageable with the pry tip, the sliding member being moveable longitudinally relative to the shank between a retracted position in which the pry tip may be inserted under a staple bridge and a clamping position in which the clamp head engages the pry tip and in which a staple bridge overlying the pry tip is releaseably secured by the clamp head. Preferably, the pry tip has a single pointed end and a substantially uniform taper. The pry tip may be conical.

In another aspect, the staple extractor of the present invention includes a clamp head engageable with a tapered pry tip, the clamp head including two opposed wings that, when the clamp head is engaged with the pry tip, straddle the pry tip. Each wing is forked and the opening between the forks of one wing is aligned with the opening between the forks of the other wing. In use, when the bridge of a staple to be removed is positioned between the forks of each wing when the sliding member is engaged with the pry tip, the forks impede movement of the staple bridge along the length of the pry tip during removal of the staple. Preferably, the pry tip is conical.

In another aspect, the staple extractor of the present invention includes a conical pry tip, which conical shape permits rotation of the pry tip incidental to insertion of the pry tip under a staple bridge, and a releaseable means for impeding movement of the staple bridge along the pry tip during extraction of a staple. Preferably, the releasable means comprises a clamp head engageable with the pry tip and having two opposed forked wings that straddle the pry tip when the clamp head is engaged with the pry tip, such that movement along the length of the pry tip of a staple bridge disposed between the forks is impeded by the forks.

Preferably, in the staple extractors of the present invention, the shank has a bend distal the pry tip, wherein in use, a mechanical advantage in removing a staple is obtainable by resting the outside of the bend against the workpiece and pivoting the staple extractor about the bend. Preferably, in the staple extractors of the present invention, the pry tip is marked to indicate a preferred position along the length of the pry tip at which to locate a staple bridge during removal of a staple.

Preferably, in the staple extractors of the present invention, there is a preferred position along the length of the pry tip at which to locate a staple bridge during removal of a staple; the opening between the forks of each wing is a V-shaped opening in that the edges of the forks defining the opening are substantially rectilinear and the edges of the forks meet at an inner corner; and when the sliding member is in the clamping position, the inner corners are aligned with the preferred position; whereby, in use, when a staple bridge is overlying the pry tip and the sliding member is moved towards the clamping position, when the edges of the forks contact the staple bridge, the edges tend to force the staple bridge towards the inner corners and thus towards the preferred position.

Preferably, in the staple extractors of the present invention, the sliding member comprises an internal bore within which a portion of the shank loosely fits so as to permit relative longitudinal movement between the sliding member and the shank. Preferably, in the staple extractors of the present invention, there is a hand operable means for moving the clamp head between the retracted and clamping positions, comprising a thumb engageable member attached to the sliding member and located proximate the handle.

DETAILED DESCRIPTION WITH REFERENCE TO THE DRAWINGS

Figure 1:
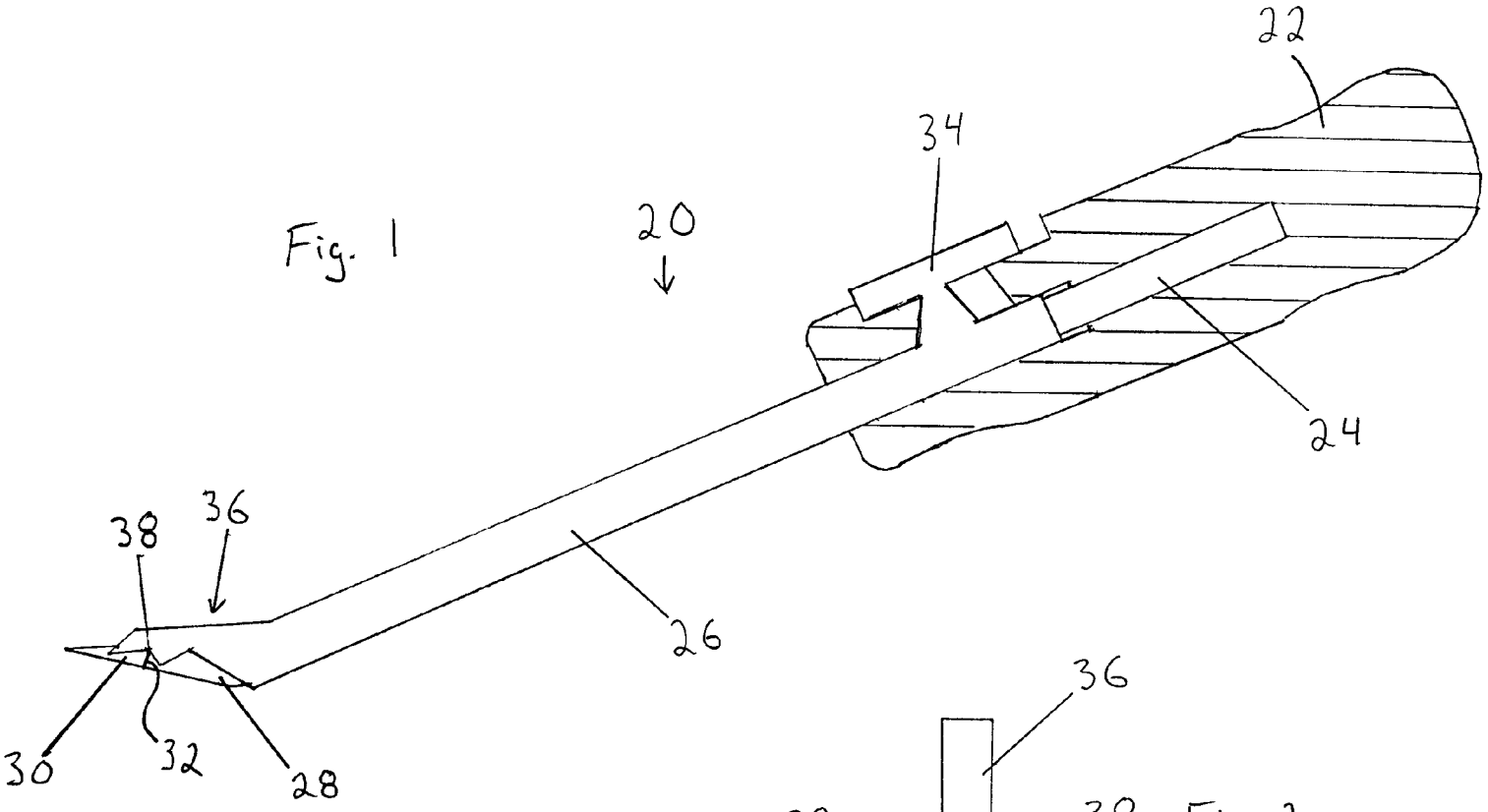
FIG. 1 is a partially sectional side view of a staple extractor embodiment of the present invention, shown in the clamping position.
Figure 2:
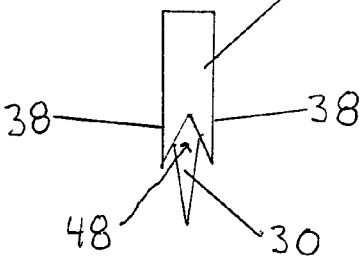
FIG. 2 is a top isolation view of the pry tip and clamp head of the embodiment shown in FIG. 1.
Figure 3:
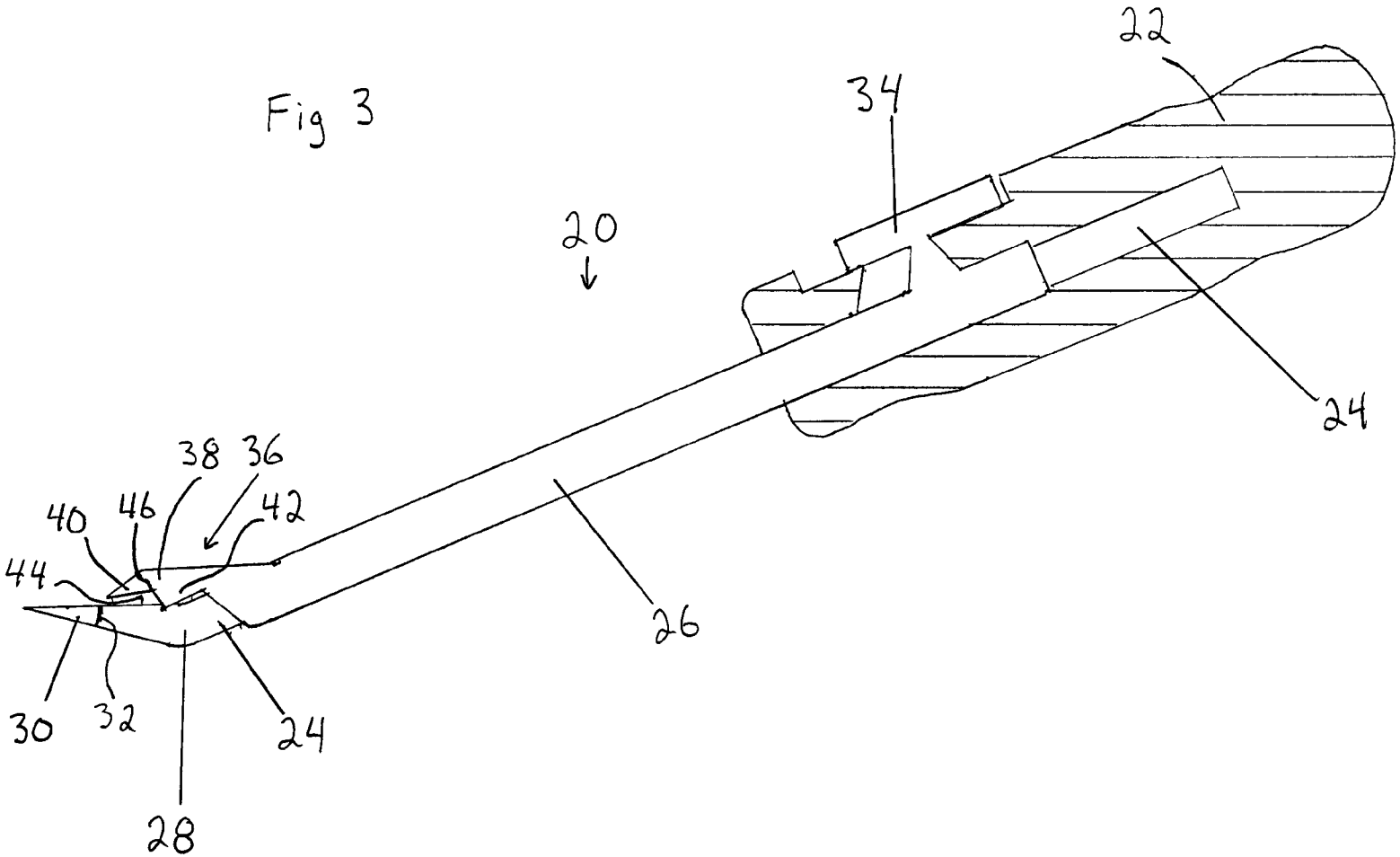
FIG. 3 is a partially sectional side view of the embodiment of FIG. 1, shown in the retracted position.

Referring to FIGS. 1 and 2, there is illustrated a staple extractor 20 embodiment of the present invention. The staple extractor 20 has a handle 22 (shown in sectional view in FIGS. 1 and 2), a shank 24 rigidly attached to the handle 22 by being partially embedded in the handle 22, and a clamp sleeve 26. The clamp sleeve 26 has an internal bore within which a portion of the shank 24 is disposed in a loose fit that permits relative longitudinal movement between the clamp sleeve 26 and the shank 24. A portion of the clamp sleeve 26 is disposed within the handle 22 in a loose fit that permits relative longitudinal movement between the clamp sleeve 26 and the handle 22.

There is a bend 28 in the shank 24 proximate the distal end of the shank 24. At the distal end of the shank 24, distal of the bend 28, there is a conical pry tip 30 (i.e the pry tip 30 is in the shape of a cone and thus has a conic curved surface). On the surface of the pry tip 30, there is a bridge mark 32 indicating the preferred position for the bridge of a staple (not shown) during removal of the staple with the staple extractor 20. The bridge mark 32 may be made by any suitable means for making a substantially indelible mark in the pry tip 30.

The clamp sleeve 26 includes a thumb knob 34 proximate the handle 22. The clamp sleeve 26 is movable longitudinally relative to the handle 22 and shank 24, by manipulation of the thumb knob 34. The clamp sleeve 26 may thus be moved between a clamping position, as shown in FIG. 1, and a retracted position, as shown in FIG. 2.

At the distal end of the clamp sleeve 26 there is a clamp head 36. The clamp head 36 includes two opposed substantially identical wings 38 that straddle the pry tip 30 when the clamp sleeve 26 is in the clamping position. Each wing 38 is bifurcated, with the forward fork 40 and rearward fork 42 of each wing 38 separated by a V-shaped opening 44, in that the edges of the forks 40, 42 defining the opening 44 are substantially rectilinear and the edges of the forks 40, 42 meet at an inner corner 46. When the clamp sleeve 26 is in the clamping position, the inner corners 46 are aligned with the bridge mark 32.

As shown in FIG. 2, between the forward forks 40, there is a V-shaped gap 48, through which a portion of the pry tip 30 may be viewed during use.

To extract a staple embedded in a material such as wood, the user holds the clamp sleeve 26 in the retracted position with the thumb knob 34; then inserts the pry tip 30 under the bridge of the staple until the bridge is in the vicinity of the bridge mark 32; then uses the thumb knob 34 to move the clamp sleeve 26 to the clamping position, thus securing the bridge; then extracts the staple, typically either by a levering motion achieved by resting the outside of the bend against the workpiece and pivoting the staple extractor about the bend, or by merely pulling the staple extractor away from the surface in which the staple is embedded; and then releases the extracted staple by moving the clamp sleeve 26 to the retracted position.

When a staple bridge is overlying the pry tip 30 and the user moves the clamp sleeve 26 towards the clamping position, when the edges of the forks 40, 42 bounding the openings 44 contact the staple bridge as the clamp sleeve 26 moves towards the clamping position, the forks 40,42 tend to force the staple bridge towards the inner corners 46 and thus towards alignment with the bridge mark 32. The edges of the forks 40, 42 bounding the openings 44 also tend to retain the staple bridge in alignment with the bridge mark 32 during extraction of the staple, by impeding movement of the staple bridge along the length of the pry tip 30.

The conical shape of the pry tip 30 permits it to be positioned as required for insertion between the bridge of a staple and the underlying material. In some situations, such as where a staple is in a confined or otherwise awkward location, it may be necessary or desirable to roll the staple extractor 20 to one side and for the user to grasp the clamp sleeve 26/shank 24 with his or her second hand in order to insert the pry tip 30 under the staple bridge. Once the pry tip 30 has been sufficiently inserted under the bridge, the staple extractor 20 may be rolled to a position relative to the staple suitable for moving the clamp sleeve 26 to the clamping position so as to extract the staple.

As will be apparent to those skilled in the art, in light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A staple extractor comprising:

a) a handle;

b) a shank having a proximal end and a distal end, and attached to the handle at the proximal end of the shank, and having a pry tip at the distal end of the shank;

c) a clamp head engageable with the pry tip and moveably attached to the shank so as to permit movement of the clamp head relative to the shank between a retracted position in which the pry tip and the clamp head are sufficiently distant one from the other so as to permit a staple bridge to be inserted between or removed from between the pry tip and the clamp head, and a clamping position in which the pry tip and clamp head are sufficiently proximate one to the other to releasably secure a staple bridge interposed between them;

d) the clamp head including two opposed wings that, when the clamp head is in the clamping position, straddle the pry tip with each wing on an opposite side of the pry tip one from the other, and wherein each wing is bifurcated and the opening between the forks of one wing is aligned with the opening between the forks of the other wing, such that in use, when the bridge of a staple is positioned between the forks of each wing when the clamp head is in the clamping position, the forks impede movement of the staple bridge along the length of the pry tip during removal of the staple; and e) hand operable means for moving the clamp head between the retracted position and the clamping position;

wherein a staple is removable by, with the clamp head in the retracted position, inserting the pry tip between a staple bridge and the underlying material, moving the clamp head to the clamping position to secure the staple bridge, pulling the thus secured staple from the underlying material, and moving the clamp head to the retracted position to release the extracted staple.

2. The staple extractor of claim 1, wherein:

a) there is a preferred position along the length of the pry tip at which to locate a staple bridge during removal of a staple;

b) the opening between the forks of each wing is a V-shaped opening in that the edges of the forks defining the opening are substantially rectilinear and the edges of the forks meet at an inner corner; and c) when the clamp head is in the clamping position, the inner corners are aligned with the preferred position;

whereby, in use, when a staple bridge is overlying the pry tip and the clamp head is moved towards the clamping position, when the edges of the forks contact the staple bridge, the edges tend to force the staple bridge towards the inner corners and thus towards the preferred position.

3. The staple extractor of claim 1, wherein the clamp head is attached to a sliding member that is moveably attached to the shank so as to permit relative longitudinal movement between the sliding member and the shank, and thus between the clamp head and the shank.

4. The staple extractor of claim 3, wherein the sliding member comprises an internal bore within which a portion of the shank loosely fits so as to permit relative longitudinal movement between the sliding member and the shank.

5. The staple extractor of 3, wherein the hand operable means comprises a thumb engageable member attached to the sliding member and located proximate the handle.

6. The staple extractor of claim 1, wherein the shank has a bend proximal the pry tip, wherein in use, a mechanical advantage in removing a staple is obtainable by resting the outside of the bend against the workpiece and pivoting the staple extractor about the bend.

7. The staple extractor of claim 1, wherein the pry tip has a single pointed end and a substantially uniform taper.

8. The staple extractor of claim 1, wherein the pry tip is conical.

9. A staple extractor comprising:

a) a handle;

b) a shank having a proximal end and a distal end, and attached to the handle at the proximal end of the shank and having a bend proximate the distal end of the shank;

c) a conical pry tip at the distal end of the shank, distal the bend, for inserting under the bridge of a staple during extraction of the staple; and d) a clamp head moveably attached to the shank so as to be moveable relative to the shank between a retracted position in which the pry tip and the clamp head are sufficiently distant one from the other so as to permit a staple bridge to be inserted between or removed from between the pry tip and the clamp head, and a clamping position in which the pry tip and clamp head are sufficiently proximate one to the other to releaseably secure a staple bridge interposed between them; the clamp head including two opposed wings that, when the clamp head is in the clamping position, straddle the pry tip with each wing on an opposite side of the pry tip one from the other, and wherein each wing is bifurcated and the opening between the forks of one wing is aligned with the opening between the forks of the other wing, such that in use, when the bridge of a staple is positioned between the forks of each wing when the clamp head is in the clamping position, the forks impede movement of the staple bridge along the length of the pry tip during removal of the staple;

wherein a staple is removable by, with the clamp head in the retracted position, inserting the pry tip between a staple bridge and the underlying material, moving the clamp head to the clamping position to secure the staple bridge, pulling the thus secured staple from the underlying material, and moving the clamp head to the retracted position to release the extracted staple.

10. The staple extractor of claim 9, wherein:

a) there is a preferred position along the length of the pry tip at which to locate a staple bridge during removal of a staple;

b) the opening between the forks of each wing is a V-shaped opening in that the edges of the forks defining the opening are substantially rectilinear and the edges of the forks meet at an inner corner; and c) when the clamp head is in the clamping position, the inner corners are aligned with the preferred position;

whereby, in use, when a staple bridge is overlying the pry tip and the clamp head is moved towards the clamping position, when the edges of the forks contact the staple bridge, the edges tend to force the staple bridge towards the inner corners and thus towards the preferred position.

11. The staple extractor of claim 9, wherein the clamp head is attached to a sliding member that is moveably attached to the shank so as to permit relative longitudinal movement between the sliding member and the shank, and thus between the clamp head and the shank.

12. The staple extractor of claim 11, wherein the sliding member comprises an internal bore within which a portion of the shank loosely fits so as to permit relative longitudinal movement between the sliding member and the shank.

13. The staple extractor of claim 9, wherein there is a thumb engageable member attached to the sliding member and located proximate the handle.

* * * * *